US006517222B1

(12) United States Patent
Orlov

(10) Patent No.: US 6,517,222 B1
(45) Date of Patent: Feb. 11, 2003

(54) SYSTEM AND METHOD FOR LEVELING SUSPENDED LIGHTING FIXTURES AND A LONGITUDUNAL AXIS

(75) Inventor: Arkady Orlov, Brooklyn, NY (US)

(73) Assignee: Linear Lighting Corp., Long Island City, NY (US)

( * ) Notice: Subject to any disclaimer, the term of this patent is extended or adjusted under 35 U.S.C. 154(b) by 0 days.

(21) Appl. No.: 09/918,513

(22) Filed: Aug. 1, 2001

(51) Int. Cl.[7] ..... F21Y 21/20

(52) U.S. Cl. ..... 362/391; 362/404; 362/285; 362/147; 248/325; 248/328

(58) Field of Search ..... 362/147, 285, 362/391, 404; 248/325, 328

(56) References Cited

U.S. PATENT DOCUMENTS

| | | | | |
|---|---|---|---|---|
| 1,673,325 A | | 6/1928 | Godley | |
| 1,679,574 A | | 8/1928 | Hyatt | |
| 2,564,328 A | | 8/1951 | Farrington et al. | |
| 2,569,859 A | | 10/1951 | Locke | |
| 2,740,885 A | | 4/1956 | Kruger | |
| 3,409,262 A | * | 11/1968 | Soule | 248/328 |
| 4,358,817 A | * | 11/1982 | Bielemeier | 362/220 |
| 5,111,369 A | | 5/1992 | Shirai et al. | |
| 5,111,370 A | * | 5/1992 | Clark | 362/147 |

* cited by examiner

*Primary Examiner*—Sandra O'Shea
*Assistant Examiner*—Ismael Negron
(74) *Attorney, Agent, or Firm*—Natter & Natter

(57) ABSTRACT

A cable suspension system for linear lighting fixtures simplifies installation procedures by providing a simple leveling adjustment compensation for weight imbalance about a longitudinal axis of the lighting fixture. A suspension cable is fixed in a bore of a cable fitting, with the cable fitting being mounted to a bracket which pivots relative to the fixture. The pivot axis is parallel to the longitudinal axis of the fixture. The angle of the bracket is adjusted relative to the fixture is adjusted such that the fixture as a whole hangs horizontally level.

20 Claims, 4 Drawing Sheets

SYSTEM AND METHOD FOR LEVELING SUSPENDED LIGHTING FIXTURES AND A LONGITUDUNAL AXIS

BACKGROUND OF THE INVENTION

1. Field of the Invention

This invention relates generally to cable suspended lighting assemblies and more particularly to a system for leveling a linear lighting fixture about its longitudinal fixture axis.

2. Antecedents of the Invention

A popular installation for linear lighting assemblies has been the suspension of lighting fixtures from braided steel cables. A linear fixture was supported by a pair of braided steel cables, the upper ends of which were anchored to a ceiling support and the lower ends of which were locked in a bore of a cable anchor. The cable anchors were positioned in registration with the longitudinal axis of the fixture, equidistantly spaced from the ends of the fixture. The cable anchors included a spring loaded locking clamp for adjustment of the effective length of the cable so that the fixture could be horizontally leveled along its longitudinal axis.

In addition to wiring and fixture costs, a significant factor in the total cost of lighting was the installation. While leveling the fixture along its longitudinal axis was relatively simple, the more difficult task was leveling the fixture about its longitudinal axis. Weight imbalances due to ballasts, sockets, related wiring, brackets and mechanical components carried within the fixture resulted in moments about the longitudinal axis of the fixture which were required to be balanced in order to hang the fixture in a horizontal plane.

Previous techniques for leveling a cable suspended fixture about its longitudinal axis included the installation and positioning of counterbalance weights within the fixture housing. Such task was labor intensive and time consuming, with workers standing on scaffolding or ladders.

SUMMARY OF THE INVENTION

The present invention comprises a leveling system for a linear lighting assembly suspended from cables. The cables hang substantially vertically from a ceiling anchor with each cable being received within the bore of a cable anchor attached to the fixture.

The cable anchor is secured to a bracket which pivots about an axis parallel to the longitudinal axis of the fixture. The bracket may be carried in an assembly strut which joins elongate side extrusions of the fixture.

The strut comprises an open channel having parallel side walls and a bottom. A bracket pivot extends through the side walls of the strut. Positioned between the strut bottom and the underside of the bracket on one side of the pivot is a compression spring while a screw extends through the bracket on the other side of the pivot and bears against the bottom of the strut. Rotation of the screw varies the plane of the cable anchor bracket relative to a reference plane of the fixture to horizontally level the reference plane and compensate for fixture weight imbalance.

From the foregoing compendium, it should be appreciated that it is an aspect of the present invention to provide a leveling system for a cable suspended lighting fixture of the general character described which is not subject to the disadvantages of the antecedents of the invention aforementioned.

It is a feature of the present invention to provide a method of leveling a cable suspended lighting fixture of the general character described which is simple to practice.

A consideration of the present invention is to provide a method of leveling a cable suspended lighting fixture of the general character described which reduces installation labor costs.

Another aspect of the present invention is to provide a leveling system for a cable suspended lighting fixture of the general character described which is relatively low in cost and suitable for economical mass production fabrication.

An additional feature of the present invention is to provide a leveling system for a cable suspended lighting fixture of the general character described whereby a reference plane extending through the fixture is horizontally leveled in the presence of a weight imbalance about the longitudinal axis of the fixture by varying the angle of an adjustment bracket.

A further consideration of the present invention is to provide a leveling system for a cable suspended lighting fixture of the general character described whereby the lighting fixture may be leveled about its longitudinal axis utilizing an adjustment screw.

Yet a further aspect of the present invention is to provide a leveling system for a cable suspended lighting fixture of the general character described which compensates for a weight imbalance varying the position of one portion of the fixture relative to a reference plane of the fixture.

To provide a leveling system for a cable suspended lighting fixture of the general character described which reduces the necessity for field installation of counterbalance weights is a further feature of the present invention.

Further aspects, features and considerations in part will be obvious and in part will be pointed out hereinafter.

With these ends in view, the invention finds embodiment in the various combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENTS

Figure 1:
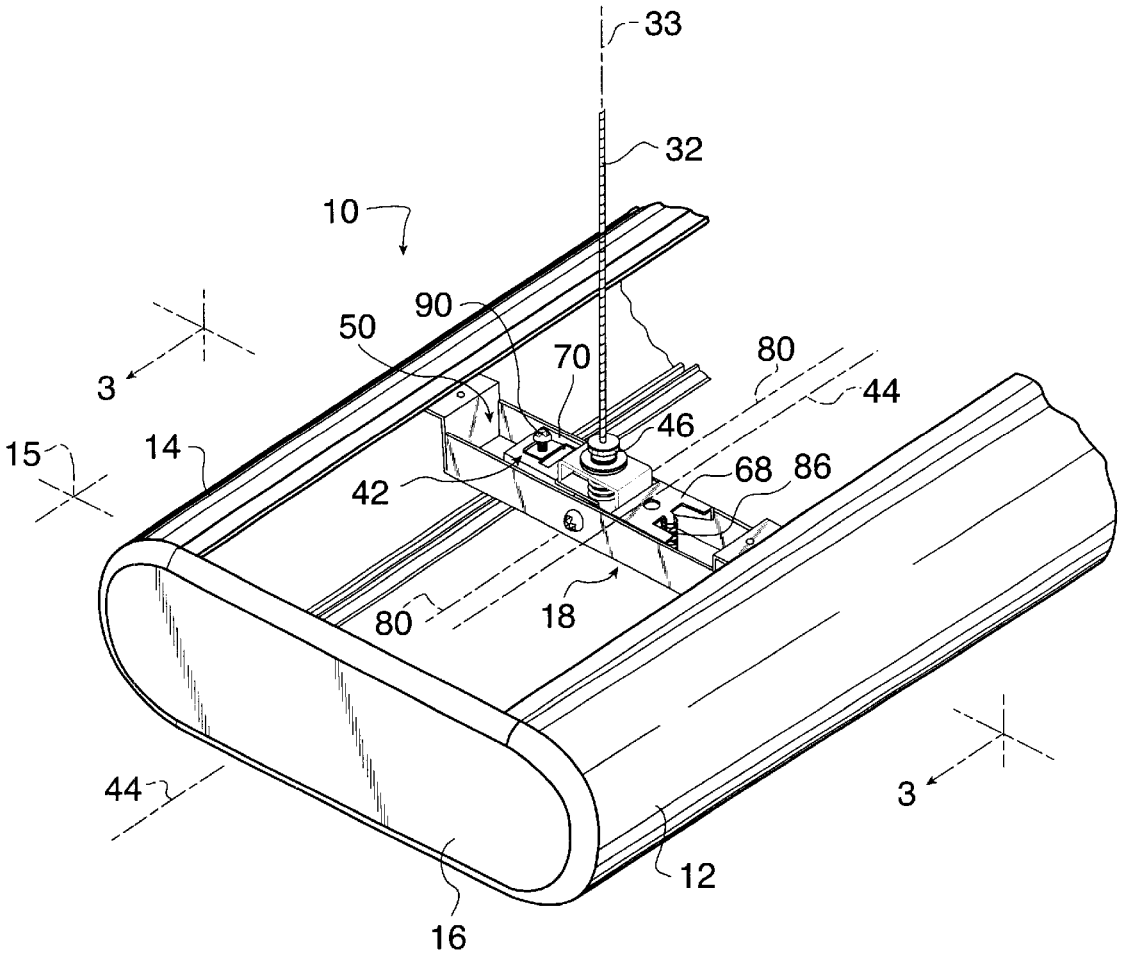
FIG. 1 is a fragmentary perspective view of a cable suspended linear lighting fixture having a leveling system construed in accordance with and embodying the present invention.

Referring now in detail to the drawings, the reference numeral 10 denotes generally a linear lighting fixture illustrated without lighting components in FIG. 1. It should be understood that the fixture is merely exemplary and that the leveling system of the present invention is equally suited for employment in lighting fixtures of other types and configurations.

The fixture 10 comprises a housing frame formed of a pair of extrusions 12, 14 which are joined together at their ends by a pair of end caps 16, only one of which is illustrated. The extrusions are additionally maintained in spaced apart relationship by at least two assembly struts 18, equidistantly spaced from the end caps 16. The upper surface of the fixture lies in a reference plane 15.

The extrusions 12, 14 generally include a plurality of internal channels which are employed for the purpose of mounting the assembly struts 18, as by screws 20, as well as lighting fixture components such as sockets employed to mount a lighting tube 22, to mount ballasts 24 and to carry associated wiring. The extrusion channels are also employed, in a conventional manner, for factory or field mounting of a course adjustment counterbalance weight 26, if necessary, and to mount light reflectors 28, which overly the ballasts, as well as a light diffuser 30.

The fixture 10 is suspended by at least two braided steel cables 32, each of which extends along a generally vertical axis 33. Each cable 32 is received, at its upper end, in an upper cable anchor 34, mounted in a utility box 36. The anchor 34 is secured to a suitable fixed ceiling member through a rod 38. A canopy 40, which lies against an exposed ceiling surface, is employed to conceal the upper mounting assembly.

Pursuant to the invention, a leveling system 42 is provided for quickly and precisely leveling the suspended fixture 10 about a longitudinal axis 44 of the fixture. It should be understood that the longitudinal axis 44 does not generally coincide with the center of gravity of the fixture.

The leveling system 42 includes cable anchor 46 having a bore 47 extending along an axis 49 for receiving the cable 32. The cable anchor 46 is of conventional configuration, e.g. Part No. 100015, available from Linear Lighting Corp., Long Island City, N.Y. Adjustment of the effective length of the cable is accomplished by releasing a spring loaded internal clamp of the cable anchor 46. Such adjustment is done at an initial stage of the fixture installation for assuring that the fixture is hung from the specified height and also for assuring that the fixture is horizontally level along the longitudinal axis 44.

The cable anchor 46 is secured in a bracket 48 which is carried within a central span 50 of the strut 18. The central span 50 includes a pair of parallel side walls 52, 54 and a bottom 56. The bottom 56 extends upwardly adjacent the ends of the side walls and thereafter extends in opposite directions as a contoured mounting flange 58, having a slot 60 which receives the mounting screw 20.

Figure 2:
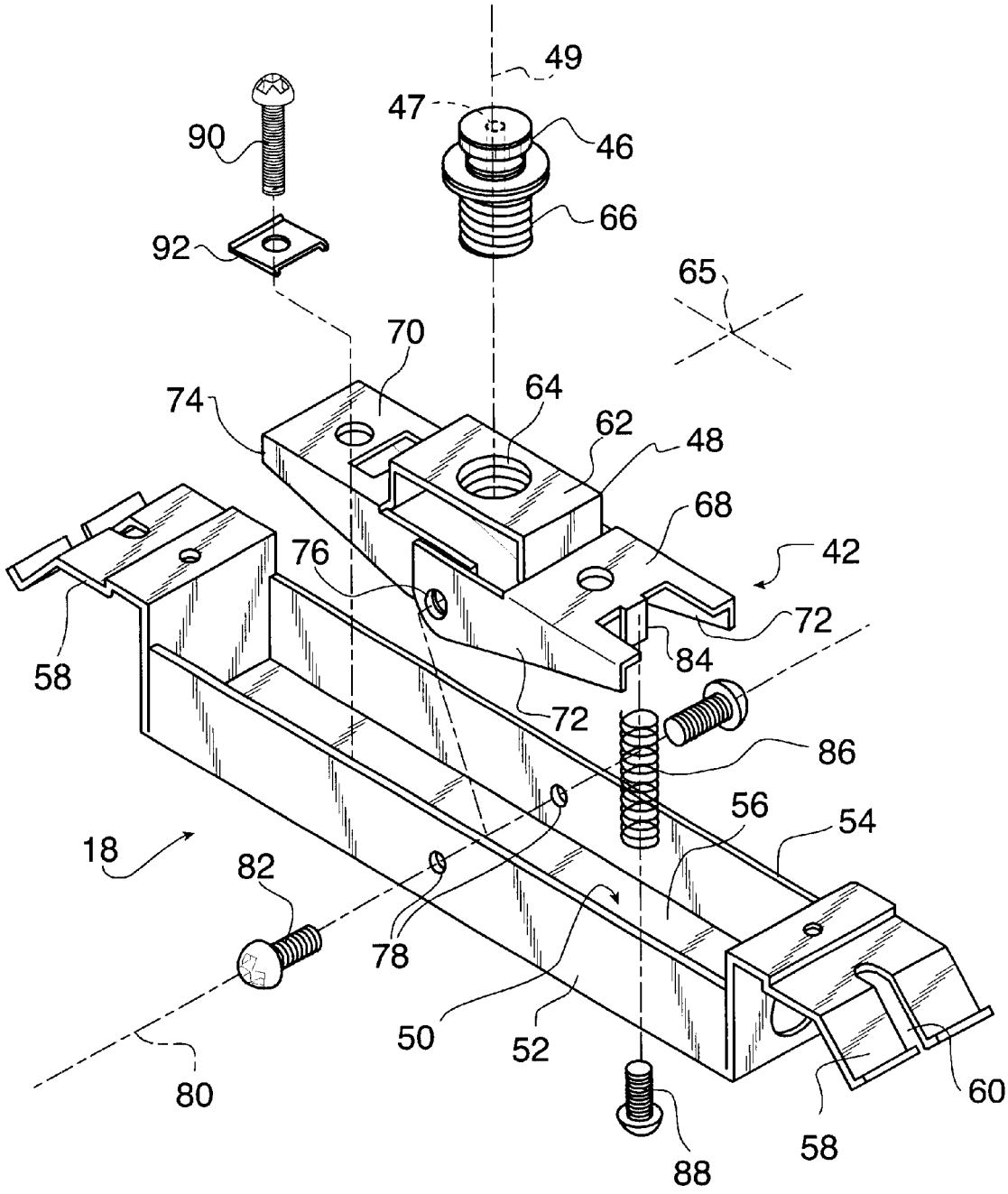
FIG. 2 comprises an enlarged scale exploded perspective view of the leveling system of the present invention and showing a fixture assembly strut, a cable anchor and an anchor bracket which is adjustably pivotable relative to the fixture.

As will be noted from an observation of FIG. 2, the bracket 48 includes a central raised platform 62 which includes a threaded bore 64 into which is received a matingly threaded mounting skirt 66 of the cable anchor 46. The platform 62 lies in a plane 65, with the bore axis 49 being perpendicular to the plane 65.

Figure 3:
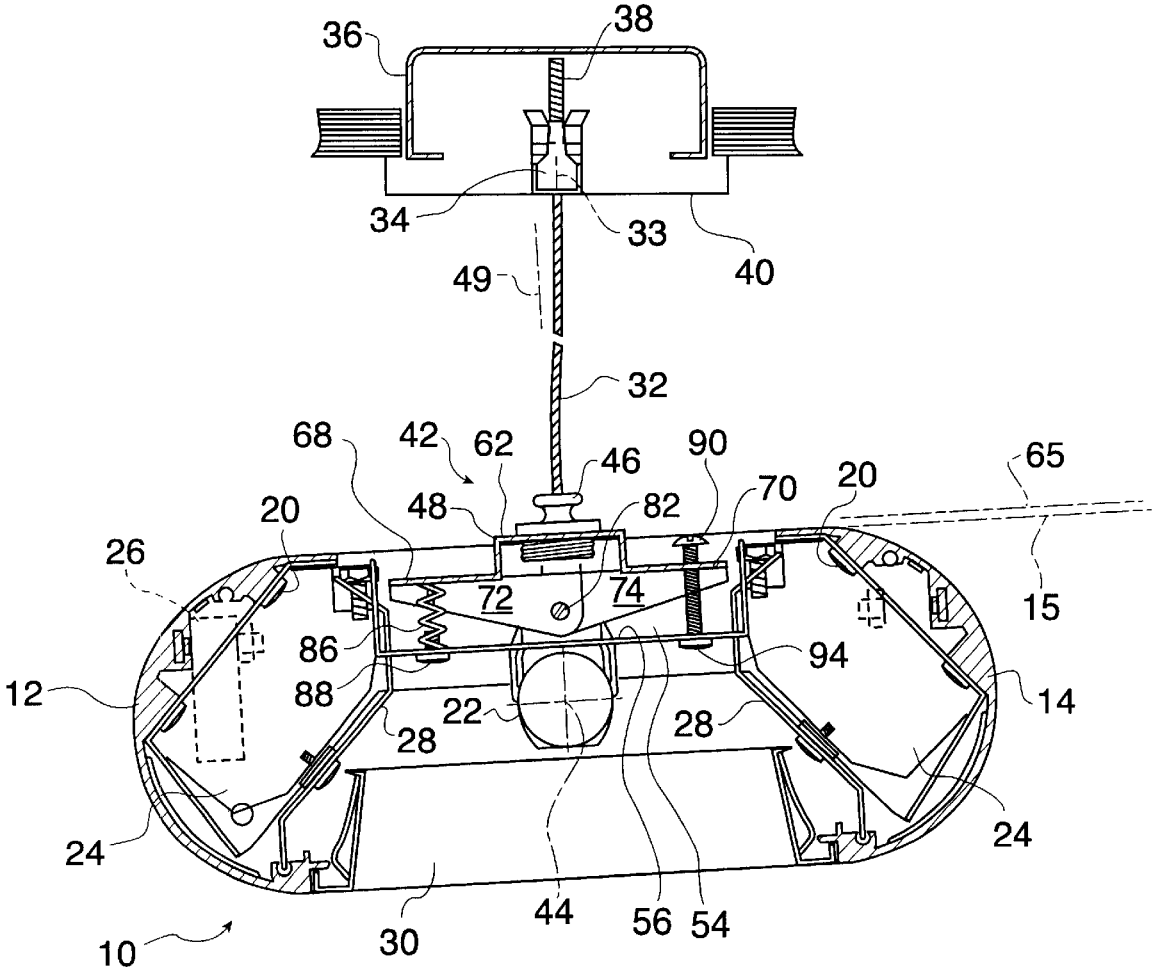
FIG. 3 is an enlarged scale sectional view through the lighting fixture and a ceiling support, the same being taken substantially along the plane 3—3 of FIG. 1 and illustrating some typical operating components of the fixture and showing the fixture as initially hung with a weight imbalance.

FIG. 3 illustrates the fixture 10 as hung with the plane 65 of the platform 62 parallel to the plane 15 of the fixture. The left side of the fixture 10 is heavier than the right side, perhaps due to field installed internal wiring. Such weight imbalance results in a counterclockwise moment imbalance. As a result, the fixture 10 is not horizontally level.

It should be noted that the portion of the cable 32 received in the bore 47 of the cable anchor 46 is at an angle other than vertical such that a portion of the cable 32 adjacent the cable anchor 46 is slightly curved, bowed or bent with an equilibrium state reached when the reference plane 15 is sloped.

In accordance with the invention, the bracket 48 is adjustable relative to the fixture 10 to horizontally level the reference plane 15 without adding counterbalance weights to the fixture 10.

By way of example, a configuration for the bracket 48 which facilitates such adjustment includes a pair of end panels 68, 70 which extend from opposite ends of the central platform 62. The bracket 48 additionally includes a pair of side panels 72 which extend from the end panel 68 and a pair of side panels 74, which extend from the end panel 70.

Portions of the side panels 72, 74 overlap one another as can be seen in FIG. 2. The outer side panels 72 are dimensioned such that the bracket 48 can be received between the side walls 52, 54 of the strut 18. A transverse bore 76 extends through the overlapped portions of the side panels 72, 74, with the bore 76 being registered with a coaxial bore 78 in the side walls 52, 54 of the strut 18.

A pin, screw or screws 82 extend through the coaxial bores 76, 78 such that the bracket 48 is capable of pivotal movement about a common bore axis 80, which is parallel to the longitudinal axis 44 of the lighting fixture 10.

A tongue 84 extends downwardly from the panel 68. The tongue 84 serves as a seat for a helical coil compression spring 86; the bottom of the spring 86 is seated over a screw 88 which extends upwardly through a threaded aperture in the bottom 56 of the strut 18.

An adjustment screw 90 extends through a U-nut or J-nut clip 92 which is secured around an aperture formed in the end panel 70. The bottom of the screw 90 is seated in a depression or well 94 formed in the bottom 56.

It will be appreciated that the spring 86 urges the bracket 48 in a counterclockwise direction, as viewed in FIG. 2, about the axis 80, with the angular position of the central platform 62 being adjusted and held fast through rotation of the adjustment screw 90.

Figure 4:
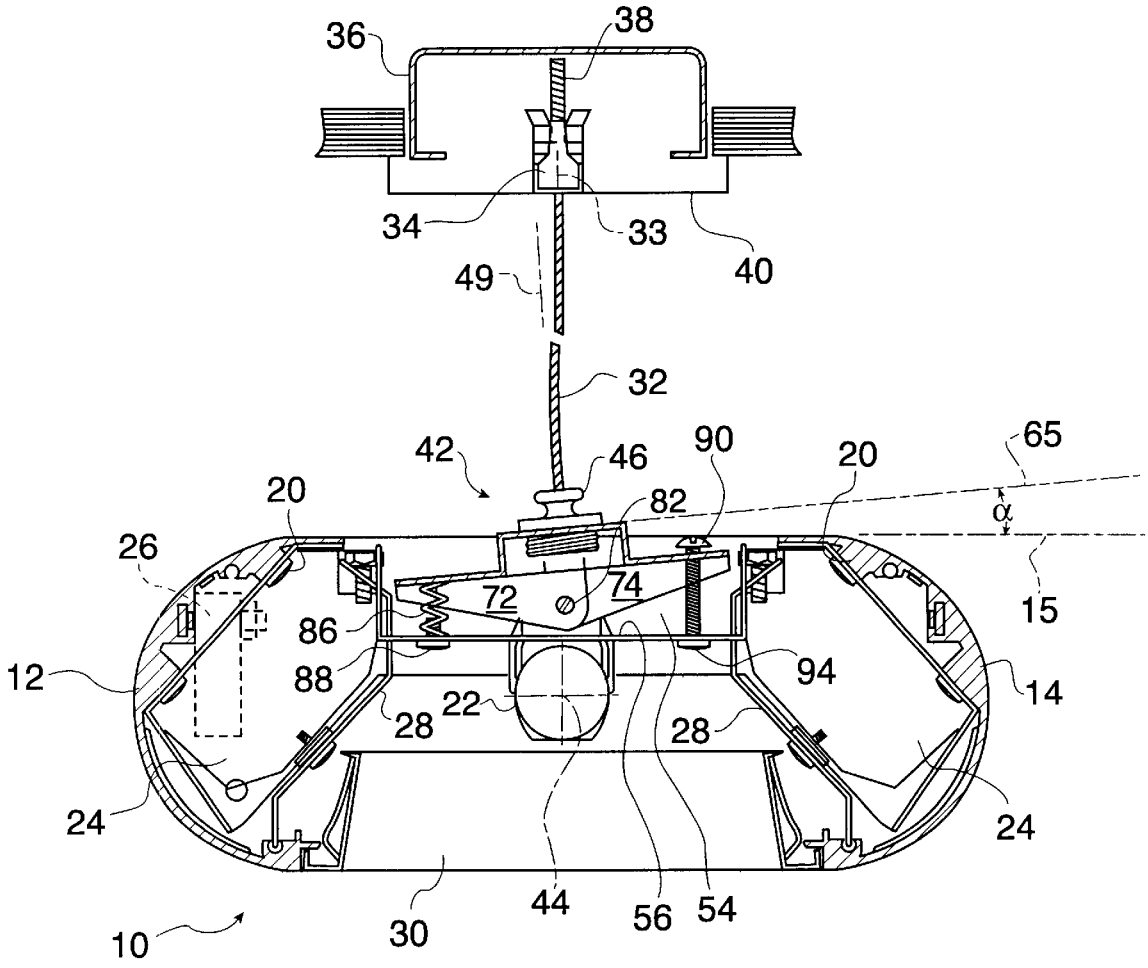
FIG. 4 is an enlarged scale sectional view through the lighting fixture, identical to that of FIG. 3 yet illustrating the fixture after adjustment of the anchor bracket to level the fixture.

By adjustment of the plane 65 of the bracket central platform 62 to other than parallel to the reference plane 15 of the lighting fixture, e.g. to the angle illustrated in FIG. 4, the fixture 10 may be leveled such that the reference plane 15 is horizontal. In the adjusted FIG. 4 position, the portion of the cable 32 received in the bore 47 of the cable anchor 46 is at the angle relative to the upper vertical portion of the cable axis 33. That is the axis 49 of the bore 47 of the cable anchor 46 is not vertical. This results in the cable being correctively curved or bowed or bent adjacent the cable anchor. It is believed that resistance to such corrective bending of the cable 32 generates a clockwise moment as viewed in FIG. 4, to compensate for the unequal weight distribution of components within the fixture such that an equilibrium state is reached, similar to that in FIG. 3. Adjustment of the bracket 48 relative to the fixture 10 levels the reference plane 15.

Thus it will be seen that there is provided a leveling system for a suspended lighting fixture which achieves the various aspects, features and considerations of the present invention and which is well suited to meet the conditions of practical usage.

Having thus described the invention there is claimed as new and desired to be secured by Letters Patent:

1. A method of suspending an object from a cable, the cable having an upper end and a lower end, the method comprising the steps of:

a) fixing the upper end of the cable to a support, b) fixing the cable to the object at a point adjacent the lower end of the cable, and c) horizontally leveling a reference plane extending through the object by imparting a curve, bow or bend to the cable adjacent the point where the cable is fixed to the object.

2. A method of suspending an object from a cable in accordance with claim 1 wherein the object includes a cable anchor having a bore, the bore including an axis, the step of fixing the cable to the object at a point adjacent the lower end of the cable includes fixing a portion of the cable adjacent the lower end of the cable in the bore and the step of imparting a curve, bow or bend to the cable includes the step of adjusting the bore relative to the reference plane such that the bore axis is other than perpendicular to the reference plane.

3. A method of suspending an object from a cable in accordance with claim 1 wherein the object comprises a lighting fixture having a longitudinal axis, the lighting fixture being suspended by a plurality of cables, the step of leveling being employed to compensate for weight distribution imbalances resulting in moments about the longitudinal axis.

4. A method of suspending a lighting fixture from a cable in accordance with claim 3 wherein the steps a), b) and c) are employed at each cable from which the fixture is suspended.

5. A moment balanced suspended lighting fixture assembly, the assembly comprising a lighting fixture, a reference plane extending through the lighting fixture, a cable extending downwardly from a support, the lighting fixture being positioned beneath the support and being suspended from the cable, a cable anchor associated with the lighting fixture, a lower end portion of the cable being retained in the cable anchor, the retained portion of the cable extending generally along an axis other than vertical with the reference plane being horizontal.

6. A moment balanced suspended lighting fixture assembly constructed in accordance with claim 5 wherein the cable anchor pivots relative to the reference plane.

7. A moment balanced suspended lighting fixture assembly constructed in accordance with claim 5 further including a bracket, the cable anchor being seated in the bracket, the bracket being pivotally mounted relative to the reference plane.

8. A moment balanced suspended lighting fixture assembly constructed in accordance with claim 7, the fixture further including a strut, the bracket being pivotally mounted to the strut.

9. A system for horizontally leveling a suspended lighting fixture, the fixture having a reference plane, an axis and unequal weight distribution about the axis, the system comprising a cable anchor and a bracket, the cable anchor having a bore for receiving an end portion of a suspension cable, the cable anchor being seated in the bracket, the bracket being pivotable relative to the reference plane about a pivot axis which is parallel to the fixture axis to compensate for a moment imbalance about the fixture axis due to the unequal weight distribution.

10. A leveling system for a suspended lighting fixture as constructed in accordance with claim 9 wherein the bracket includes a platform, the bore of the cable anchor extending perpendicular from the plane of the platform, the plane of the platform being pivotable about the pivot axis.

11. A leveling system for a suspended lighting fixture as constructed in accordance with claim 9, the bracket including a screw for fixing the position of the bracket relative to the reference plane.

12. A leveling system for a suspended lighting fixture as constructed in accordance with claim 9, the bore having an axis, the bracket being pivoted to a position wherein the bore axis is at an angle other than perpendicular with respect to the reference plane.

13. A method of leveling a lighting fixture suspended from at least one cable, the lighting fixture having a reference plane extending therethrough, the method comprising the steps of:

a) fixing a lower end of the cable to a portion of the lighting fixture which is movable relative to the reference plane, and b) adjustably moving the movable portion of the lighting fixture relative to the reference plane until the reference plane is horizontally level.

14. A method of leveling a lighting fixture in accordance with claim 13 further including the step of:

c) fixing the movable portion of the lighting fixture relative to the reference plane when the reference plane is horizontally level.

15. A method of leveling a lighting fixture in accordance with claim 13 wherein the lighting fixture is suspended from a plurality of cables, the method further comprising employing steps a) and b) at each cable.

16. A method of leveling a lighting fixture in accordance with claim 13 wherein the step of moving includes pivoting the movable portion of the lighting fixture relative to the reference plane.

17. A method of leveling a lighting fixture in accordance with claim 16 wherein the lighting fixture includes a longitudinal axis parallel to the reference plane, the step of pivoting further including pivoting the movable portion of the lighting fixture about a pivot axis which is parallel to the longitudinal axis.

18. A method of leveling a lighting fixture in accordance with claim 13 wherein the step of fixing the lower end of the cable includes mounting a cable anchor to the movable portion of the lighting fixture and securing the lower end of the cable in the cable anchor.

19. A method of leveling a lighting fixture in accordance with claim 18 wherein the step of moving the movable portion of the lighting fixture includes pivoting the movable portion of the lighting fixture relative to the reference plane.

20. A method of leveling a lighting fixture in accordance with claim 18, wherein the cable anchor includes a bore having an axis, the step of securing the lower end of the cable in the cable anchor including fixing the lower end of the cable in the bore and the step of adjustably moving the movable portion of the lighting fixture relative to the reference plane including the step of positioning the bore axis at an angle other than perpendicular with respect to the reference plane.

* * * * *